US008033867B1

(12) United States Patent
Kessler et al.

(10) Patent No.: US 8,033,867 B1
(45) Date of Patent: Oct. 11, 2011

(54) UNIVERSAL POWER ADAPTER

(76) Inventors: Kerry L Kessler, Parkland, FL (US); Joan S Kessler, Parkland, FL (US)

( * ) Notice: Subject to any disclaimer, the term of this patent is extended or adjusted under 35 U.S.C. 154(b) by 0 days.

(21) Appl. No.: 12/796,917

(22) Filed: Jun. 9, 2010

(51) Int. Cl.
*H01R 25/00* (2006.01)

(52) U.S. Cl. ..... 439/652

(58) Field of Classification Search ..... 439/650–654, 439/214
See application file for complete search history.

(56) References Cited

U.S. PATENT DOCUMENTS

| | | | | |
|---|---|---|---|---|
| 4,543,624 | A | 9/1985 | Rumble | |
| 5,106,317 | A | 4/1992 | Taylor | |
| 5,159,545 | A | 10/1992 | Lee | |
| 5,540,596 | A | 7/1996 | Bothe et al. | |
| 5,613,863 | A | 3/1997 | Klaus et al. | |
| 5,616,051 | A | 4/1997 | Rogers et al. | |
| 5,791,921 | A | 8/1998 | Lee | |
| 5,829,993 | A | 11/1998 | Wu | |
| 5,906,509 | A | 5/1999 | Wu | |
| 5,934,919 | A * | 8/1999 | Cross et al. | 439/136 |
| 5,998,964 | A | 12/1999 | Martensson | |
| 6,220,880 | B1 * | 4/2001 | Lee et al. | 439/214 |
| 6,302,717 | B1 | 10/2001 | Cheung | |
| 6,328,581 | B1 * | 12/2001 | Lee et al. | 439/653 |
| 6,382,996 | B1 | 5/2002 | Eyman | |
| 6,692,284 | B1 | 2/2004 | Koh | |
| 7,052,298 | B1 | 5/2006 | Cheng | |
| 7,223,126 | B2 | 5/2007 | Ng | |
| 7,347,734 | B1 * | 3/2008 | Teitelbaum | 439/652 |
| 7,365,964 | B2 | 4/2008 | Donahue, IV | |
| 7,556,511 | B1 * | 7/2009 | Hsu et al. | 439/214 |
| 7,597,570 | B2 | 10/2009 | So | |
| 2004/0253854 | A1 | 12/2004 | Lee et al. | |

FOREIGN PATENT DOCUMENTS

EP PCTEP2007009503 5/2009

* cited by examiner

*Primary Examiner* — Briggitte R Hammond
(74) *Attorney, Agent, or Firm* — Gold & Rizvi, P.A.; Glen E. Gold; H. John Rizvi

(57) ABSTRACT

A universal multi-outlet power strip adapter having a series of removable power adapters in electro-mechanical communication with a respective series of receptacle assemblies. The receptacle assemblies are disposed within a casing, in electrical communication with a power input plug extending outward from the casing. Each removable power adapter includes an adapter body, an adapter receptacle, and an adapter contact configuration. Each adapter contact configuration is configured to mate with a power outlet receptacle of a different country outlet configuration. The adapter receptacle is configured to electro-mechanically engage with each of the various country outlet configurations. In use, an individual user removes the removable power adapter for a desired country and inserts the removable power adapter between the power input plug and the power supply outlet. The user connects power plugs from electrically operated devices to the series of removable power adapters connected to the respective receptacle assembly within the casing to distribute power to the devices.

20 Claims, 7 Drawing Sheets

UNIVERSAL POWER ADAPTER

FIELD OF THE INVENTION

The present disclosure generally relates to an apparatus for adapting a power strip to a power outlet of any country. More particularly, the present disclosure relates to a plug strip comprising a series of removable adapters having a universal receptacle, each adapter comprising a unique plug configuration for mating to a specific power outlet.

BACKGROUND OF THE INVENTION

A power strip (also known as an extension lead, power board and by many other variations) includes a series of sockets, which allows multiple devices to be plugged in. The series of sockets are in electrical communication with a flexible power cable. The series of sockets are disposed within a casing, wherein the flexible power cable extends from the casing.

As technology advances, the number of electronic devices requiring power increases. The power strip provides a means for distributing power from a single power outlet to multiple electronic devices. Therefore, the desire and applications for use of power strips continues to increase.

The need for multiple power outlets is not limited at one's home or office. The plug strips are designed to plug into a single power outlet configuration. The series of sockets are normally the same configuration as the plug, thus limiting the application to countries having the respective power outlet configuration. Travelers frequently encounter situations where a plug strip would be beneficial. Hotel accommodations, cruise ship cabins, and the like offer a limited number of power outlets. The traveler would benefit from having a plurality of power outlets available in a close proximity for such uses as a hair dryer, a curling iron, a razor power adapter, a computer power adapter, a cellular telephone power adapter, and the like.

Additionally, common plug strips include a series of sockets in a fixed configuration. Much of today's electronics require a transformer. Plug strips are not configured to accommodate a plurality of transformers.

Portable electronic devices, such as cellular telephones utilise charging interfaces through a Universal Serial Buss (USB) interface.

Therefore, it would be desirable to have a power strip capable of powering a series of electrically operated devices throughout the world.

SUMMARY OF THE INVENTION

The present disclosure is generally directed to universal multi-outlet power strip adapter, the adapter comprising:

a casing;

a flexible power cable comprising a power input plug having a plurality of power input contacts;

a voltage A power distribution buss being assembled within the casing, the voltage A power distribution buss being in electrical communication with one power input contact;

a voltage B power distribution buss being assembled within the casing, the voltage A power distribution buss being in electrical communication with a second power input contact;

a series of receptacle assemblies disposed within the casing, each receptacle having a voltage A conduit providing electrical communication between a first power receptacle interface and the voltage A power distribution buss and a voltage B conduit providing electrical communication between a first power receptacle interface and the voltage B power distribution buss:

a series of removable power adapters, each power adapter comprising an adapter body, an adapter receptacle, and an adapter contact configuration, wherein a first adapter plug configuration of a first removable power adapter is arranged to engage with a first country outlet configuration and a second adapter plug configuration of a second removable power adapter is arranged to engage with a different country outlet configuration; and the first and second power receptacle interfaces of each receptacle assembly of the series of receptacle assemblies are configured to receive one of the removable power adapters of the series.

In a second aspect, the adapter receptacle is configured to receive at least two different power plug configurations.

In yet another aspect, the receptacle voltage conduit is slideably assembled to the respective voltage power distribution buss.

In another aspect, the series of removable power adapters comprises at least four unique power plug configurations.

While, in yet another aspect, the series of removable power adapters comprise at least five unique power plug configurations.

In still another aspect, the power plug configurations of the series of removable power adapters is configured including at least two adapters having different contact configurations selected from a list of contact configurations including:

a. a pair of flat blade contacts in an opposing parallel arrangement, b. a pair of flat blade contacts in an opposing non-parallel arrangement, c. a pair of larger diameter round contacts;

d. a pair of smaller diameter round contacts; and e. a trio of rectangular contacts.

In a still further aspect, the universal multi-outlet power strip adapter further comprises a power conversion circuit, such as a transformer.

While another aspect provides at least one USB power connector integrated into the universal multi-outlet power strip adapter.

Whereas in another aspect, the universal multi-outlet power strip adapter further comprises a cover.

In another aspect, the cover is slideably attached to the casing.

While in yet another aspect, the cover is hingeably attached to the casing.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which:

FIG. 4 presents an isometric view of another exemplary removable power adapter, the adapter comprising a contact configuration for use with an outlet configuration commonly used in countries such as the United Kingdom, Singapore, and the like;

FIG. 5 presents an isometric view of another exemplary removable power adapter, the adapter comprising a contact configuration for use with an outlet configuration commonly used in countries such as Austria, Denmark, Portugal, Sweden, and the like;

FIG. 6 presents an isometric view of another exemplary removable power adapter, the adapter comprising a contact configuration for use with an outlet configuration commonly used in countries such as Ethiopia, India, Malaysia, Nigeria, and the like;

FIG. 7 presents an isometric view of another exemplary removable power adapter, the adapter comprising a contact configuration for use with an outlet configuration commonly used in countries such as Australia, New Zealand, Tasmania, and the like;

FIG. 8 presents an isometric view of another exemplary removable power adapter, the adapter comprising a contact configuration for use with an outlet configuration commonly used in countries such as United States, Brazil, Mexico, Taiwan, and the like;

Like reference numerals refer to like parts throughout the various views of the drawings.

DETAILED DESCRIPTION OF THE INVENTION

Figure 1:
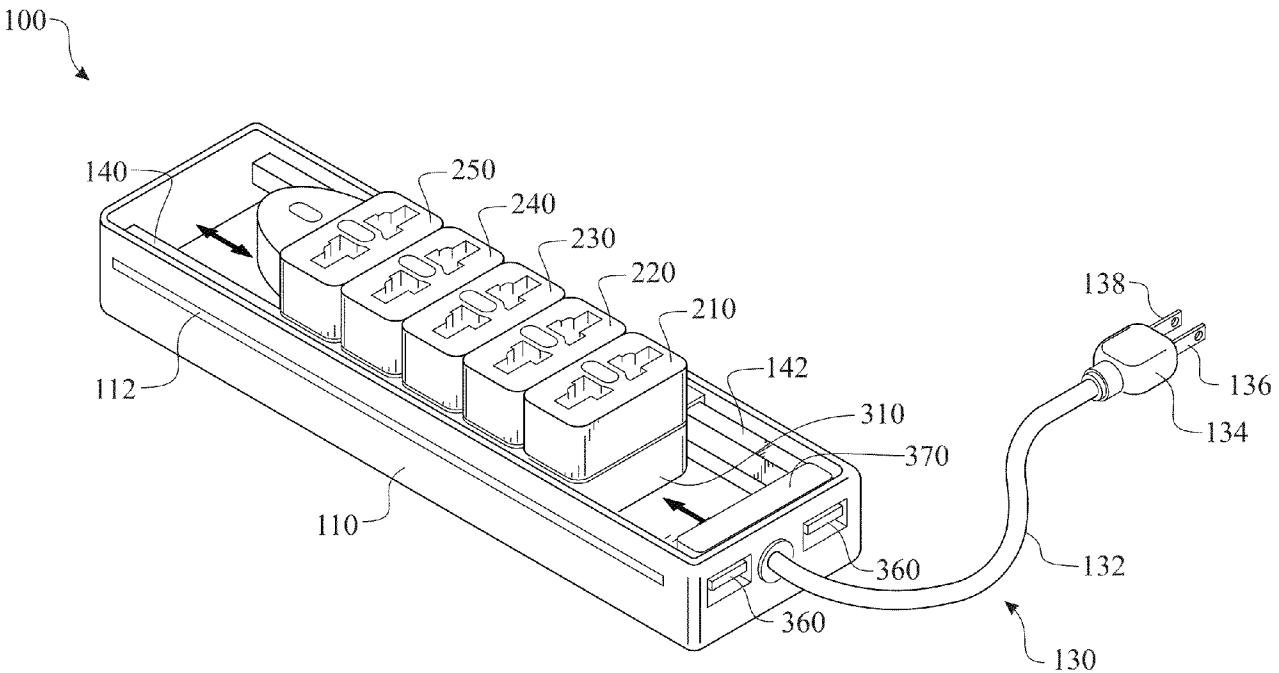
FIG. 1 presents an isometric view of an exemplary universal multi-outlet power strip adapter assembly.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

An exemplary universal multi-outlet power strip adapter assembly 100 is presented in FIGS. 1 through 10. The universal multi-outlet power strip adapter assembly 100 distributes power from a wall power outlet assembly 400 to a series of power receptacles. The series of power receptacles provides power to a plurality of electrically operated devices.

The universal multi-outlet power strip adapter assembly 100 includes an adapter casing 110 providing a primary element for the assembly of the apparatus. An electrical circuit is provided to transfer electricity from a source, such as a wall power outlet assembly 400 to each of the series of power receptacles. The electrical circuit includes a plug assembly comprising a power input plug 134, a voltage A power input contact 136 and a voltage B power input contact 138, a flexible cable 132 and a pair of distribution busses 126, 128. A voltage A power distribution buss 126 and a voltage B power distribution buss 128 are assembled within the adapter casing 110. Electrical wires (not shown, but well understood) within the flexible cable 132 provide electrical communication between the electrical input contact 136, 138 and each respective distribution buss 126, 128. A transformer 140, or other power regulating circuit can be integrated into the electrical circuit to adjust the input power as needed. The transformer 140 can include a surge protection circuit. Power regulating circuits are well known by experts in electrical design.

A series of power receptacle assemblies 310, 320, 330, 340, 350 are integrated into the universal multi-outlet power strip adapter assembly 100. Details of each power receptacle assembly are provided in FIG. 3. Using the first power receptacle assembly 310 as an example, the first power receptacle assembly 310 comprises one first power receptacle 314 in electrical communication with the voltage A power distribution buss 126 and a second first power receptacle 314 in electrical communication with the voltage B power distribution buss 128. A first power receptacle body 312 is preferably of a molded plastic, supporting the first power receptacle 314, the first voltage A conduit 316, and the first voltage B conduit 318. The first power receptacle 314 is configured for receiving a pair of flat blade contacts in an opposing parallel arrangement, the configuration being commonly associated with electrical interface configurations in countries such as United States, Brazil, Mexico, Taiwan, and the like. A second power receptacle assembly 320 comprises the elements of the first power receptacle assembly 310, where like features of second power receptacle assembly 320 and first power receptacle assembly 310 are numbered the same except incremented by the numeral '32'. The second power receptacle 324 is configured for receiving a pair of flat blade contacts in an opposing non-parallel arrangement, the configuration being commonly associated with electrical interface configurations in countries such as Australia, New Zealand, Tasmania, and the like. A third power receptacle assembly 330 comprises the elements of the first power receptacle assembly 310, where like features of third power receptacle assembly 330 and first power receptacle assembly 310 are numbered the same except incremented by the numeral '33'. The third power receptacle 334 is configured for receiving a receptacle for receiving a pair of larger diameter round contacts, the configuration being commonly associated with electrical interface configurations in countries such as Ethiopia, India, Malaysia, Nigeria, and the like. A fourth power receptacle assembly 340 comprises the elements of the first power receptacle assembly 310, where like features of fourth power receptacle assembly 340 and first power receptacle assembly 310 are numbered the same except incremented by the numeral '34'. The fourth power receptacle 344 is configured for receiving a receptacle for receiving a pair of smaller diameter round contacts, the configuration being commonly associated with electrical interface configurations in countries such as Austria, Denmark, Portugal, Sweden, and the like. A fifth power receptacle assembly 350 comprises the elements of the first power receptacle assembly 310, where like features of fifth power receptacle assembly 350 and first power receptacle assembly 310 are numbered the same except incremented by the numeral '35'. The fifth power receptacle 354 is configured for receiving a receptacle for receiving a trio of rectangular contacts, the configuration being commonly associated with electrical interface configurations in countries such as United Kingdom, Singapore, and the like. The first voltage A conduit 316 can be rigidly or slideably coupled to the voltage A power distribution buss 126. The slideable interface allows the user to adjust the position of each power receptacle assembly 310, 320, 330, 340, 350 to accommodate oversized plugs such as transformers.

At least one USB interface 360 can be incorporated into the universal multi-outlet power strip adapter assembly 100. A power management circuit 370 can be integrated into the power distribution system to regulate, apportion, and convert the power to each of the at least one USB interface 360.

Figure 2:
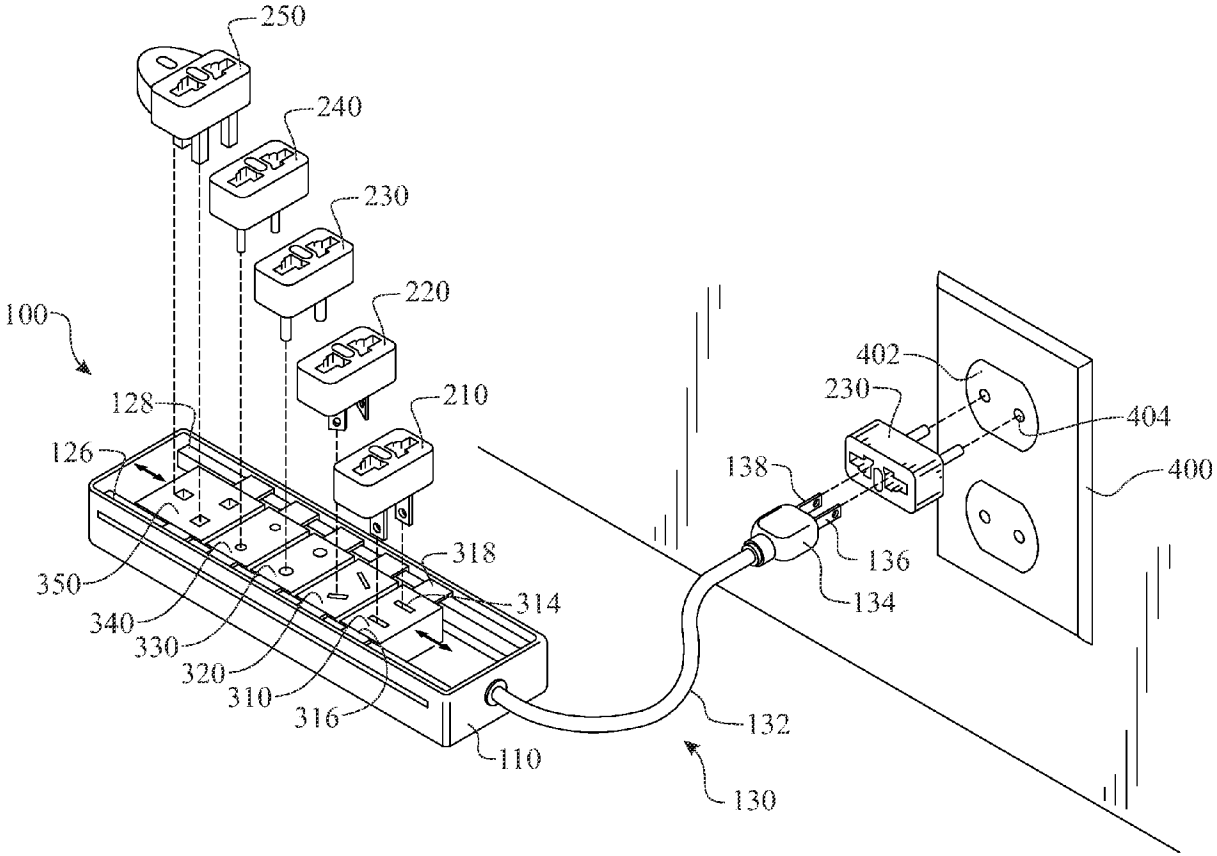
FIG. 2 presents an isometric view of the exemplary universal multi-outlet power strip adapter apparatus of FIG. 1, illustrated having each of a series of removable power adapters disengaged from the assembly.
Figure 3:
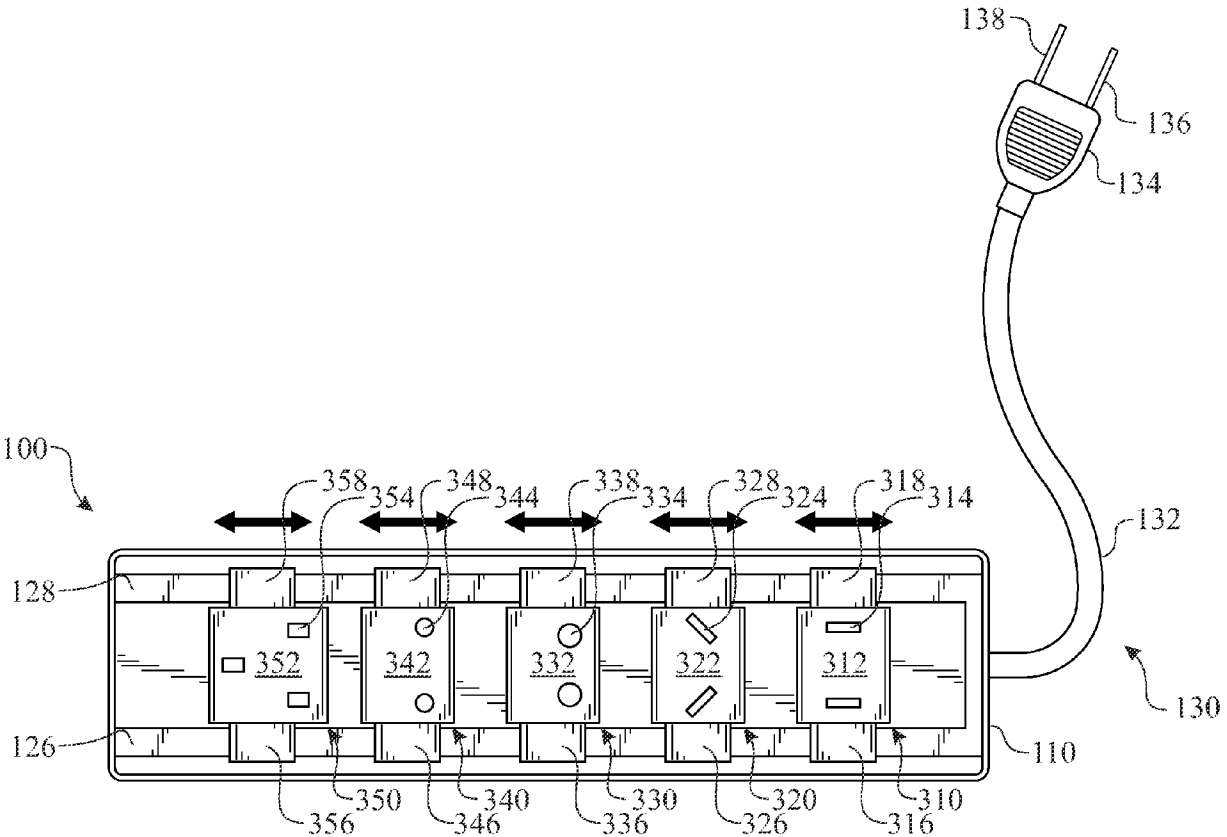
FIG. 3 presents a top view of the universal multi-outlet power strip adapter apparatus of FIG. 1, illustrated having each of a series of removable power adapters removed from the assembly for clarity.

A series of removable power adapters 210, 220, 230, 240, 250 are removably inserted into each respective power receptacle assembly 310, 320, 330, 340, 350 as illustrated in FIG. 2.

Figure 8:
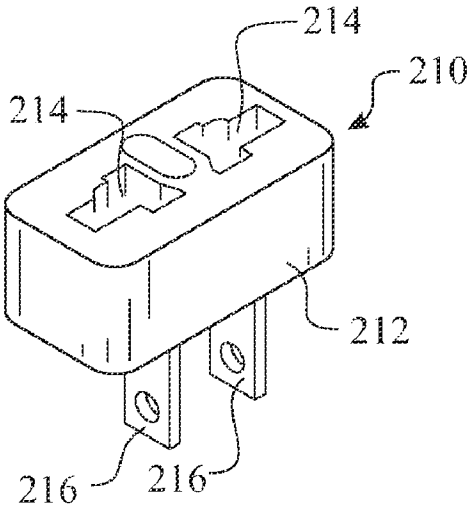

The first removable power adapter 210 is illustrated in FIG. 8 and comprises a pair of first removable power adapter contact 216, wherein the pair of first removable power adapter contact 216 comprise a pair of flat blade contacts in an opposing parallel arrangement, the configuration being commonly associated with electrical interface configurations in countries such as United States, Brazil, Mexico, Taiwan, and the like. A pair of first removable power adapter receptacle 214 is provided for receiving a plug from any of the five exemplary configurations. The five exemplary plug configurations are superimposed providing an outline to design one common receptacle capable of engaging with all five exemplary plug configurations. A first removable power adapter body 212 is preferably of a molded plastic, supporting the first removable power adapter receptacle 214 and the first removable power adapter contact 216. The first removable power adapter receptacle 214 and first removable power adapter contact 216 are in electrical communication providing a means for conveying electrical power.

Figure 7:
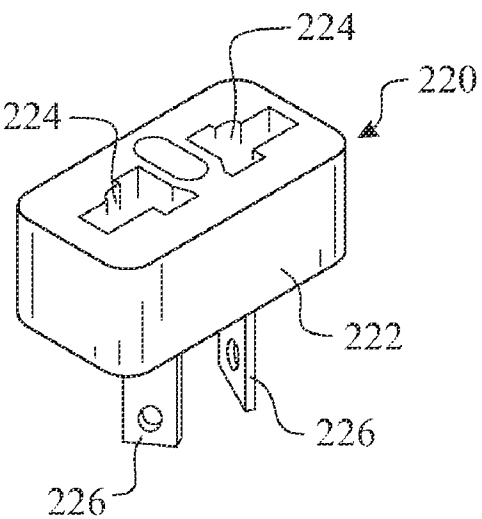
Figure 9:
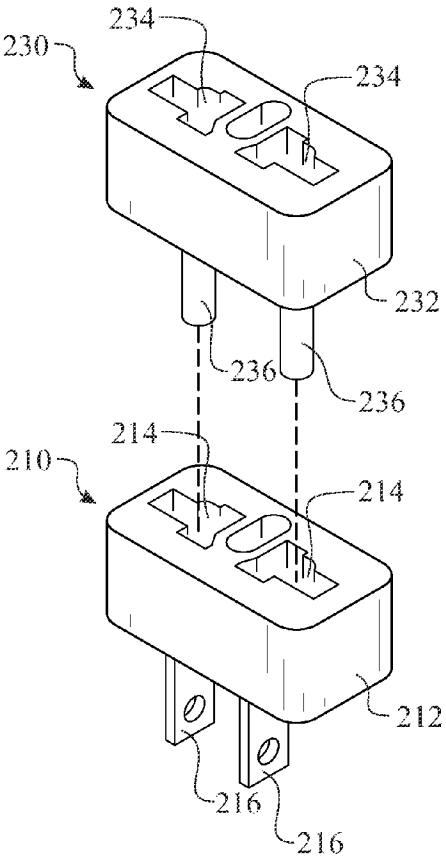
FIG. 9 presents an isometric view of two different removable power adapters providing an exemplary illustration of an engaging interface provided therebetween.

The second removable power adapter 220 is illustrated in FIG. 7 and comprises a pair of second removable power adapter contact 226, wherein the pair of second removable power adapter contact 226 comprise a pair of flat blade contacts in an opposing non-parallel arrangement, the configuration being commonly associated with electrical interface configurations in countries such as Australia, New Zealand, Tasmania, and the like. A second removable power adapter 220 comprises the elements of the first removable power adapter 210, where like features of second removable power adapter 220 and first removable power adapter 210 are numbered the same except incremented by the numeral '22'.

Figure 6:
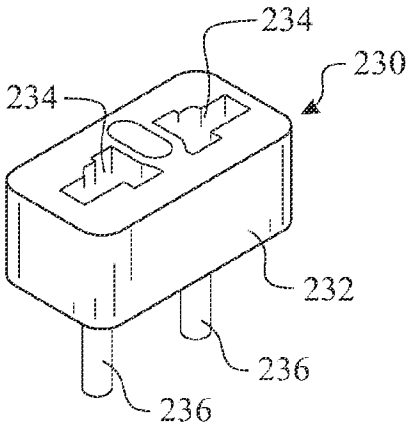

The third removable power adapter 230 is illustrated in FIG. 6 and comprises a pair of third removable power adapter contact 236, wherein the pair of third removable power adapter contact 236 comprise a pair of larger diameter round contacts, the configuration being commonly associated with electrical interface configurations in countries such as Ethiopia, India, Malaysia, Nigeria, and the like. A third removable power adapter 230 comprises the elements of the first removable power adapter 210, where like features of third removable power adapter 230 and first removable power adapter 210 are numbered the same except incremented by the numeral '23'.

Figure 5:
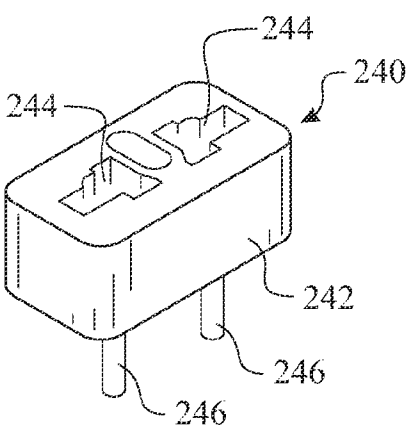

The fourth removable power adapter 240 is illustrated in FIG. 5 and comprises a pair of fourth removable power adapter contact 246, wherein the pair of fourth removable power adapter contact 246 comprise a pair of smaller diameter round contacts, the configuration being commonly associated with electrical interface configurations in countries such as Austria, Denmark, Portugal, Sweden, and the like. A fourth removable power adapter 240 comprises the elements of the first removable power adapter 210, where like features of fourth removable power adapter 240 and first removable power adapter 210 are numbered the same except incremented by the numeral '24'.

Figure 4:
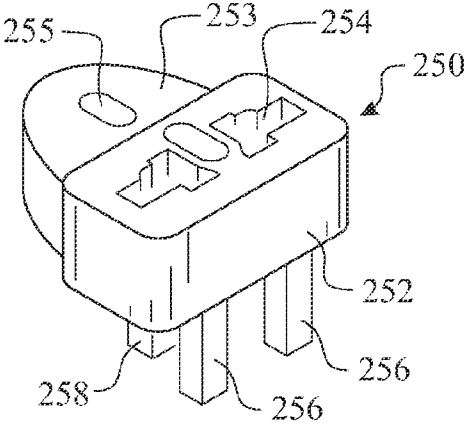

The fifth removable power adapter 250 is illustrated in FIG. 4 and comprises a trio of fifth removable power adapter contact 256, wherein the trio of fifth removable power adapter contact 256 comprise square contacts, the configuration being commonly associated with electrical interface configurations in countries such as United Kingdom, Singapore, and the like. A fifth removable power adapter 250 comprises the elements of the first removable power adapter 210, where like features of fifth removable power adapter 250 and first removable power adapter 210 are numbered the same except incremented by the numeral '25'.

The removable power adapter receptacles 214, 224, 234, 244, 254 are designed to receive each of the various configurations of the removable power adapter contacts 216, 226, 236, 246, 256. By utilizing the series of removable power adapters 210, 220, 230, 240, 250, each removable power adapter 210, 220, 230, 240, 250 can receive any the five exemplary plug configurations. This allows the traveler to utilize the universal multi-outlet power strip adapter assembly 100 with any electrically powered device having any of the five exemplary plug configurations. The power input plug 134 comprises one contact configuration. When the user is traveling, and visiting a country having a source power outlet 402 that differs from the contact configuration of the power input plug 134, the user would remove the respective removable power adapter 210, 220, 230, 240, 250, and insert the selected removable power adapter 210, 220, 230, 240, 250 between the power input plug 134 and the source power outlet 402.

Figure 10:
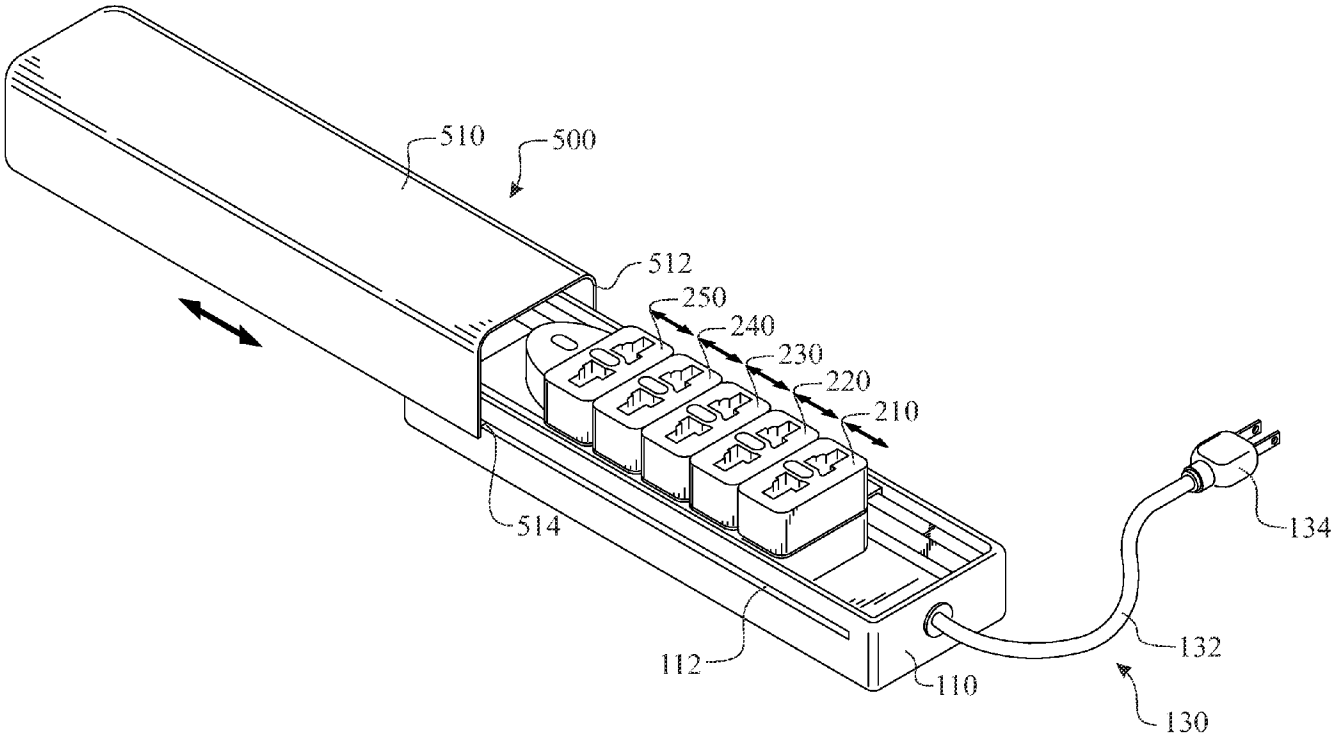
FIG. 10 presents an isometric view of the exemplary universal multi-outlet power strip adapter apparatus of FIG. 1, introducing an exemplary adapter cover.

The universal multi-outlet power strip adapter assembly 100 can include a cover, such as the exemplary cover assembly 500 illustrated in FIG. 10. The cover assembly 500 is fabricated having a sliding cover 510. The sliding cover 510 is can be of any shape to cover the series of removable power adapters 210, 220, 230, 240, 250 when assembled to the adapter casing 110. The exemplary cover assembly 500 slideably engages with the adapter casing 110. The sliding cover 510 includes a cover opening edge 512 and a coupling tab 514. The cover opening edge 512 is shaped respective to the cross sectional shape of the sliding cover 510 and to sufficiently clear the removable power adapters 210, 220, 230, 240, 250 during closure. A coupling tab 514 slideably engages with the cover receiving slot 112, providing a sliding motion for opening/closing the cover assembly 500.

It is understood that the receptacle configuration of the power receptacle assemblies 310, 320, 330, 340, 350 can be the same as the receptacle configuration of the removable power adapters 210, 220, 230, 240, 250.

The removable power adapters 210, 220, 230, 240, 250 can be colored, color coded, or marked in any other manner to provide a unique identifier to aid in associated each removable power adapter 210, 220, 230, 240, 250 with a respective country. The packaging would include a table or other identifying reference associated with the unique identifier for the user.

The exemplary cover 500 presents a sliding interface. It is understood that the cover can be hinged, a snap on, or of any other mechanical interface configuration. The cover can be more complex, providing access to each individual removable power adapter 210, 220, 230, 240, 250.

The adapter casing 110 can include a channel, hook, clips, or similar providing for storage of the power input cable assembly 130. The power input cable assembly 130 would be wrapped about the adapter casing 110, maintained in position by the channel, hook, clips, or similar. Alternately, the power input cable assembly 130 can be retractable into a cavity integrated into the adapter casing 110.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A universal multi-outlet power strip adapter assembly, comprising:

a casing;

a flexible power cable including a power input plug having a plurality of power input contacts arranged in a first plug configuration corresponding to an electrical outlet configuration of a first country;

a voltage A power distribution buss assembled within the casing, the voltage A power distribution buss in electrical communication with one power input contact;

a voltage B power distribution buss assembled within the casing, the voltage B power distribution buss in electrical communication with a second power input contact;

a series of receptacle assemblies disposed within the casing, each receptacle assembly having a receptacle body, a voltage A conduit providing electrical communication between a first power receptacle interface and the voltage A power distribution buss, and a voltage B conduit providing electrical communication between a first power receptacle interface and the voltage B power distribution buss, wherein the electrical conduits of each receptacle assembly of the series of receptacle assemblies is provided having a unique configuration comprising a form factor directly corresponding to a respective unique country electrical outlet configuration; and a series of removable power adapters, each power adapter comprising a power adapter body, a power adapter receptacle configuration, and a power adapter contact configuration, wherein each of the power adapter contact configurations is uniquely adapted for mechanical and electrical releasable engagement with said corresponding series of receptacle assemblies, and wherein each adapter has an identical universal adapter receptacle configuration capable of receiving any country plug configuration, wherein each of said series of removable power adapters are removably assembled to each respective receptacle assembly;

wherein said apparatus is provided in a manner enabling a user to select a removable power adapter respective to a specific country electrical outlet configuration, and said selected removable power adapter can be removed and inserted between a wall outlet and said power input plug for power adaptation.

2. A universal multi-outlet power strip adapter assembly as recited in claim 1, the receptacle assemblies being slideably attached to the adapter assembly.

3. A universal multi-outlet power strip adapter assembly as recited in claim 1, wherein the adapter receptacle of at least one removable power adapter is configured to electro-mechanically engage with at least two different contact configurations.

4. A universal multi-outlet power strip adapter assembly as recited in claim 1, wherein at least one receptacle configuration of the respective receptacle assembly is configured to electro-mechanically engage with at least two different contact configurations.

5. A universal multi-outlet power strip adapter assembly as recited in claim 1, wherein the adapter contact configurations of the series of removable power adapters is configured including at least two adapters having different contact configurations selected from a list of contact configurations comprising:

a. a pair of flat blade contacts in an opposing parallel arrangement, b. a pair of flat blade contacts in an opposing non-parallel arrangement, c. a pair of larger diameter round contacts;

d. a pair of smaller diameter round contacts; and e. a trio of rectangular contacts.

6. A universal multi-outlet power strip adapter assembly as recited in claim 1, further comprising a power management circuit, wherein the power management circuit converts an input power configuration to a different output power configuration.

7. A universal multi-outlet power strip adapter assembly as recited in claim 6, further comprising at least one Universal Serial Bus (USB) power interface.

8. A universal multi-outlet power strip adapter assembly as recited in claim 1, wherein each of the removable power adapters are uniquely identified, the unique identifier being respective to a receptacle reference index.

9. A universal multi-outlet power strip adapter assembly, the adapter assembly comprising:

a casing;

a power input plug having a plurality of power input contacts arranged in a first plug configuration corresponding to an electrical outlet configuration of a first country;

a voltage A power distribution buss being assembled within the casing, the voltage A power distribution buss being in electrical communication with one power input contact;

a voltage B power distribution buss being assembled within the casing, the voltage B power distribution buss being in electrical communication with a second power input contact;

a series of receptacle assemblies disposed within the casing, each receptacle assembly having a receptacle body, a voltage A conduit providing electrical communication between a first power receptacle interface and the voltage A power distribution buss and a voltage B conduit providing electrical communication between a first power receptacle interface and the voltage B power distribution buss, wherein the electrical conduits of each receptacle assembly of the series of receptacle assemblies are provided having a unique configuration comprising a form factor directly corresponding to a unique country electrical outlet configuration, wherein at least one receptacle assembly includes a;

a series of removable power adapters, each power adapter assembly comprising a power adapter body, a power adapter receptacle, and a power adapter contact configuration, wherein each of the power adapter contact configurations is uniquely adapted for mechanical and electrical releasable engagement with said corresponding series of receptacle assemblies, and wherein each adapter has an identical universal adapter receptacle configuration capable of receiving any country plug configuration, wherein each of said series of removable power adapters are removably assembled to each respective receptacle assembly; and wherein the unique power adapter contact configurations of the series of removable power adapters are configured including at least two different contact configurations selected from a list of contact configurations comprising:

a. a pair of flat blade contacts in an opposing parallel arrangement, b. a pair of flat blade contacts in an opposing non-parallel arrangement, c. a pair of larger diameter round contacts;

d. a pair of smaller diameter round contacts; and e. a trio of rectangular contacts, wherein said power strip adapter is provided in a manner enabling a user to select a removable power adapter respective to a specific country electrical outlet configuration, and said selected removable power adapter can be removed and inserted between a wall outlet and said power input plug for power adaptation.

10. A universal multi-outlet power strip adapter assembly as recited in claim 9, wherein the adapter receptacle of at least one removable power adapter is configured to electro-mechanically engage with at least two different contact configurations.

11. A universal multi-outlet power strip adapter assembly as recited in claim 9, further comprising a power management circuit, wherein the power management circuit converts an input power configuration to a different output power configuration.

12. A universal multi-outlet power strip adapter assembly as recited in claim 11, further comprising at least one Universal Serial Bus (USB) power interface.

13. A universal multi-outlet power strip adapter assembly as recited in claim 9, the receptacle assemblies being slideably attached to the adapter assembly.

14. A universal multi-outlet power strip adapter assembly as recited in claim 9, wherein each of the removable power adapters are uniquely identified, the unique identifier being respective to a receptacle reference index.

15. A universal multi-outlet power strip adapter assembly, the adapter assembly comprising:

a casing;

a power input plug having a plurality of power input contacts arranged in a first plug configuration corresponding to an electrical outlet configuration of a first country;

a voltage A power distribution buss being assembled within the casing, the voltage A power distribution buss being in electrical communication with one power input contact;

a voltage B power distribution buss being assembled within the casing, the voltage B power distribution buss being in electrical communication with a second power input contact;

a series of receptacle assemblies disposed within the casing, each receptacle assembly having a receptacle body, a voltage A conduit providing electrical communication between a first power receptacle interface and the voltage A power distribution buss and a voltage B conduit providing electrical communication between a first power receptacle interface and the voltage B power distribution buss, wherein the electrical conduits of each receptacle assembly of the series of receptacle assemblies is provided having a unique configuration comprising a form factor directly corresponding to a respective unique country electrical outlet configuration;

a series of removable power adapters, each power adapter comprising a power adapter body, a power adapter receptacle, and a power adapter contact configuration, wherein each of the power adapter contact configurations is uniquely adapted for mechanical and electrical releasable engagement with said corresponding series of receptacle assemblies, and wherein each adapter has an identical adapter receptacle configuration capable of receiving any country plug configuration, wherein each of said series of removable power adapters are removably assembled to each respective receptacle assembly; and wherein the adapter contact configurations of the series of removable power adapters is configured including at least two adapters having different contact configurations selected from a list of contact configurations comprising:

a. a pair of flat blade contacts in an opposing parallel arrangement, b. a pair of flat blade contacts in an opposing non-parallel arrangement, c. a pair of larger diameter round contacts;

d. a pair of smaller diameter round contacts; and e. a trio of rectangular contacts wherein said power strip adapter is provided in a manner enabling a user to select a removable power adapter respective to a specific country electrical outlet configuration, and said selected removable power adapter can be removed and inserted between a wall outlet and said power input plug for power adaptation.

16. A universal multi-outlet power strip adapter assembly as recited in claim 15, further comprising a power management circuit, wherein the power management circuit converts an input power configuration to a different output power configuration.

17. A universal multi-outlet power strip adapter assembly as recited in claim 16, further comprising at least one Universal Serial Bus (USB) power interface.

18. A universal multi-outlet power strip adapter assembly as recited in claim 15, wherein at least one receptacle configuration of the respective receptacle assembly is configured to electro-mechanically engage with at least two different contact configurations.

19. A universal multi-outlet power strip adapter assembly as recited in claim 15, wherein each of the removable power adapters are uniquely identified, the unique identifier being respective to a receptacle reference index.

20. A universal multi-outlet power strip adapter assembly as recited in claim 15, further comprising a cover for accessibly enclosing the series of removable power adapters within the assembly.

* * * * *